United States Patent [19]

Wright

[11] Patent Number: 4,717,156

[45] Date of Patent: Jan. 5, 1988

[54] TOSSING GAME

[76] Inventor: John C. Wright, 7 Cypress Cir., Newport, Ark. 72112

[21] Appl. No.: 866,457

[22] Filed: May 23, 1986

[51] Int. Cl.[4] ..... A63B 67/00

[52] U.S. Cl. ..... 273/401; 273/34 R; 273/178 R

[58] Field of Search ..... 273/398–402, 273/34, 178, 180, 336, 344–346, 428, 416

[56] References Cited

U.S. PATENT DOCUMENTS

| | | | |
|---|---|---|---|
| 432,170 | 7/1890 | Scott | 273/400 X |
| 1,230,503 | 6/1917 | Miller | 273/336 |
| 1,419,554 | 6/1922 | Ganse | 273/400 |
| 2,287,113 | 6/1942 | Markey | 273/401 |
| 2,933,318 | 4/1960 | Boynton | 273/178 R |
| 3,161,410 | 12/1964 | Cunningham | 273/345 |
| 3,822,063 | 7/1974 | Rea | 273/400 |
| 4,054,120 | 10/1977 | Foley | 273/346 X |
| 4,204,682 | 5/1980 | Brown | 273/34 B X |
| 4,392,653 | 7/1983 | Blume, Sr. | 273/400 |

FOREIGN PATENT DOCUMENTS

| | | | |
|---|---|---|---|
| 600499 | 4/1948 | United Kingdom | 124/62 |

*Primary Examiner*—Paul E. Shapiro

*Attorney, Agent, or Firm*—Walker & McKenzie

[57] ABSTRACT

A tossing game including first and second base members for placement on a substantially horizontal support surface spaced apart from one another, each of the base members having a cavity with an upwardly opened mouth and being in the shape of a truncated cone. First and second target members are fitted substantially submerged into the cavities of the first and second base members respectively. Each of the target members has a cavity with an upwardly opened, flared outwardly mouth. A plurality of cylindrical projectile components are provided for being tossed at the opened mouth of the first or second target means. Each projectile component has a first end and a second end with the first end heavier than the second end.

4 Claims, 6 Drawing Figures

TOSSING GAME

BACKGROUND OF THE INVENTION

1. Field of the Invention

The present invention relates, in general, to games in which a projectile is tossed toward a target or the like.

2. Description of the Related Art

A preliminary patentability search in class 273, subclasses 398, 400 and 428 disclosed the following patents: Thomas, U.S. Pat. No. 324,189; De Wolf, U.S. Pat. No. 638,220; Voege, U.S. Pat. No. 712,159; Parker, U.S. Pat. No. 867,935; Atkins, U.S. Pat. No. 966,984; Knight, U.S. Pat. No. 1,542,063; Nekuda, U.S. Pat. No. 1,873,211; Darby, U.S. Pat. No. 2,126,245; Meyer, U.S. Pat. No. 3,761,087; Davis, U.S. Pat. No. 3,843,124; Orser, U.S. Pat. No. 4,319,755; Blume, U.S. Pat. No. 4,392,653; and Cook, U.S. Pat. No. 4,423,877. None of the above patents disclose or suggest the present invention.

SUMMARY OF THE INVENTION

The present invention is directed toward providing a toss type game which can be played indoors or outdoors. The concept of the present invention is to provide at least one target means having a cavity with an upwardly opened mouth for being substantially submerged; and a plurality of cylindrical projectile components for being tossed at the opened mouth of the target means.

BRIEF DESCRIPTION OF THE DRAWINGS

FIG. 5 is a somewhat diagrammatic view of certain components of the present invention shown in conjunction with a beach or the like.

FIG. 6 is a somewhat diagrammatic view of certain components of the present invention shown in conjunction with an interior floor or the like.

DESCRIPTION OF THE PREFERRED EMBODIMENT

The tossing game of the present invention includes at least one target means having a cavity with an upwardly open mouth for being substantially submerged, and a plurality of cylindrical projectile components for being tossed at the opened mouth of the target means.

Figure 1:
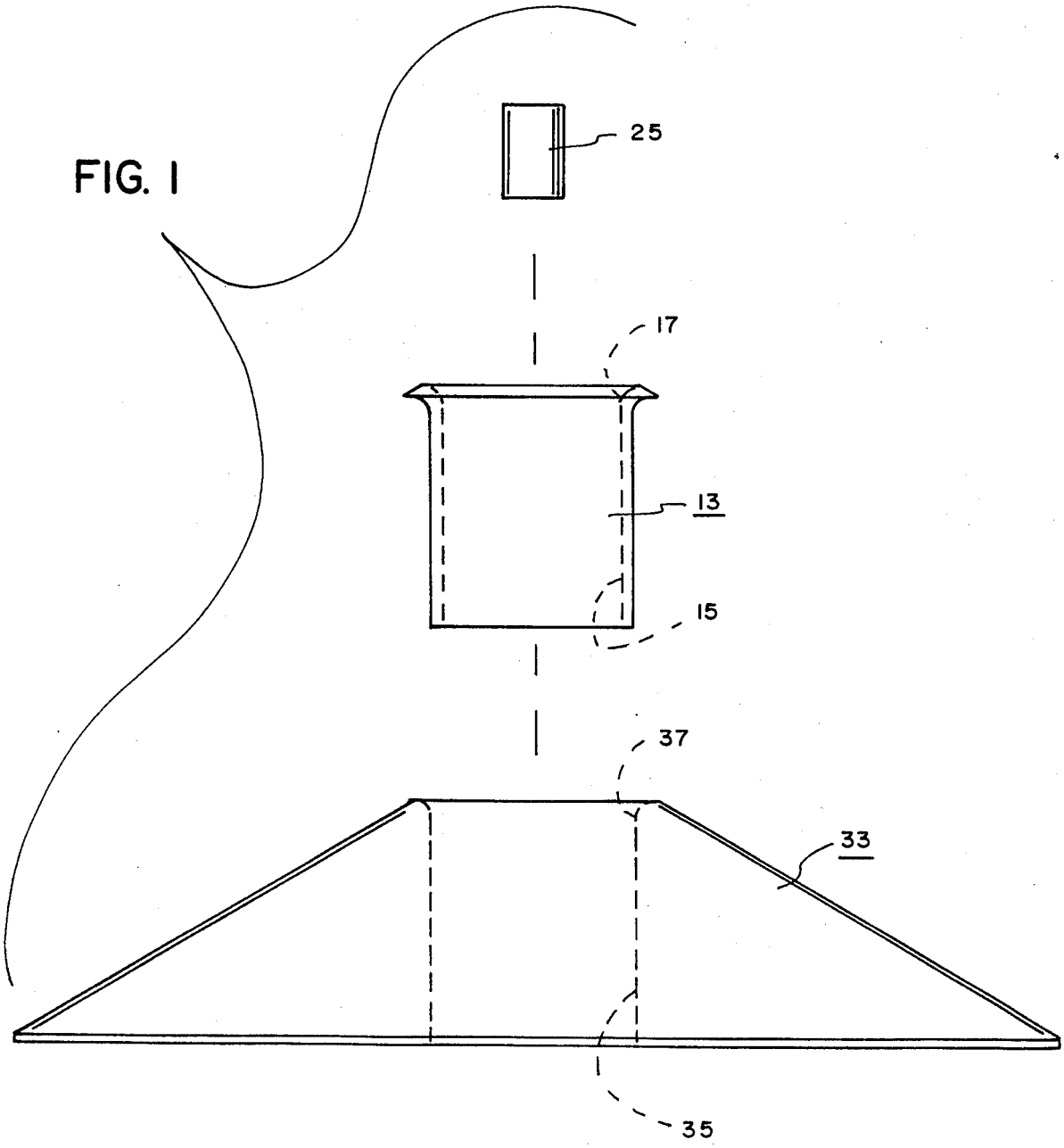
FIG. 1 is an exploded front elevational view of certain components of the tossing game of the present invention.
Figure 2:
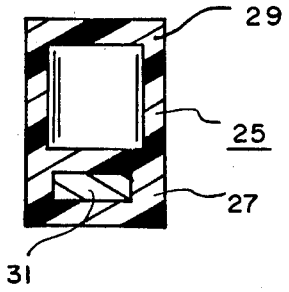
FIG. 2 is a sectional view of one projectile component of the tossing game of the present invention.
Figure 3:
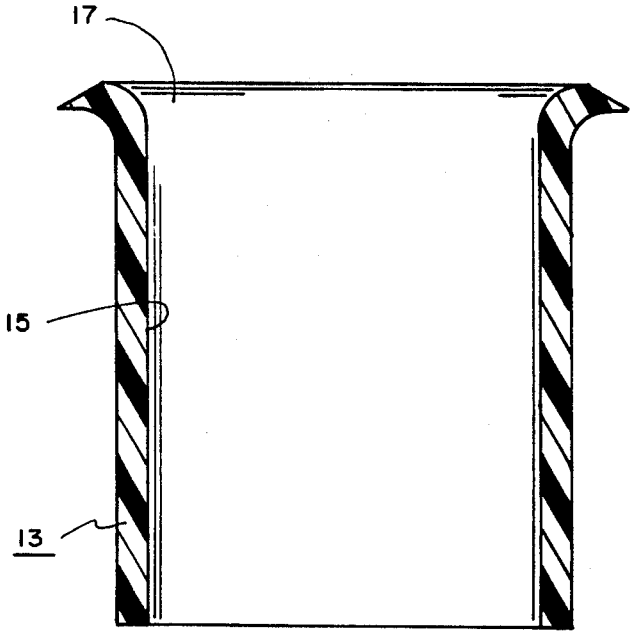
FIG. 3 is a sectional view of one target means of the tossing game of the present invention.
Figure 4:
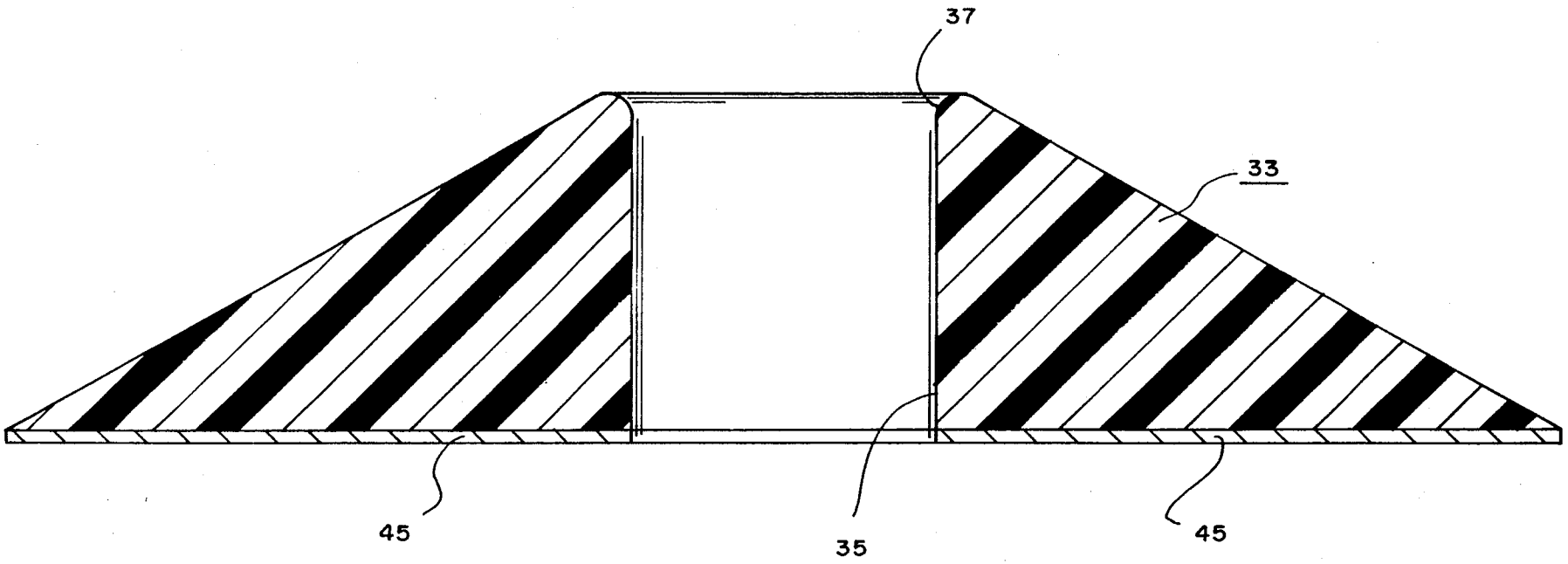
FIG. 4 is a sectional view of one base means of the tossing game of the present invention.
Figure 5:
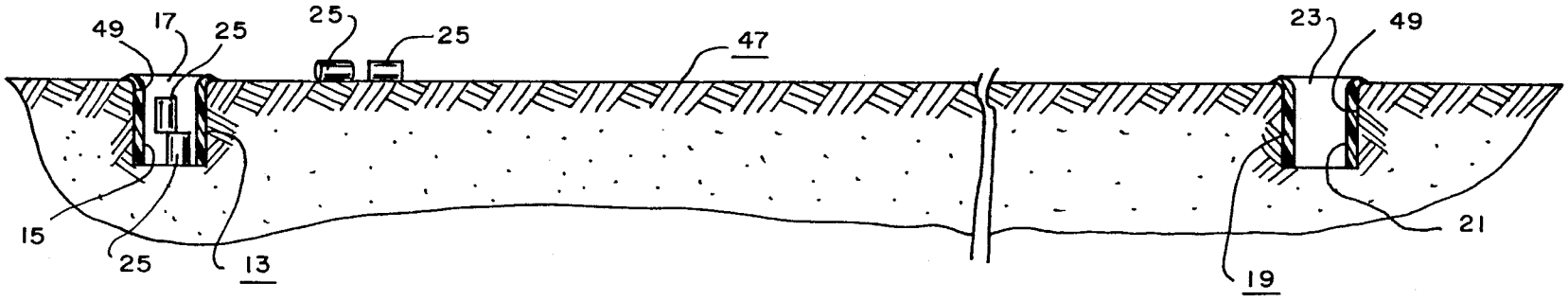
Figure 6:
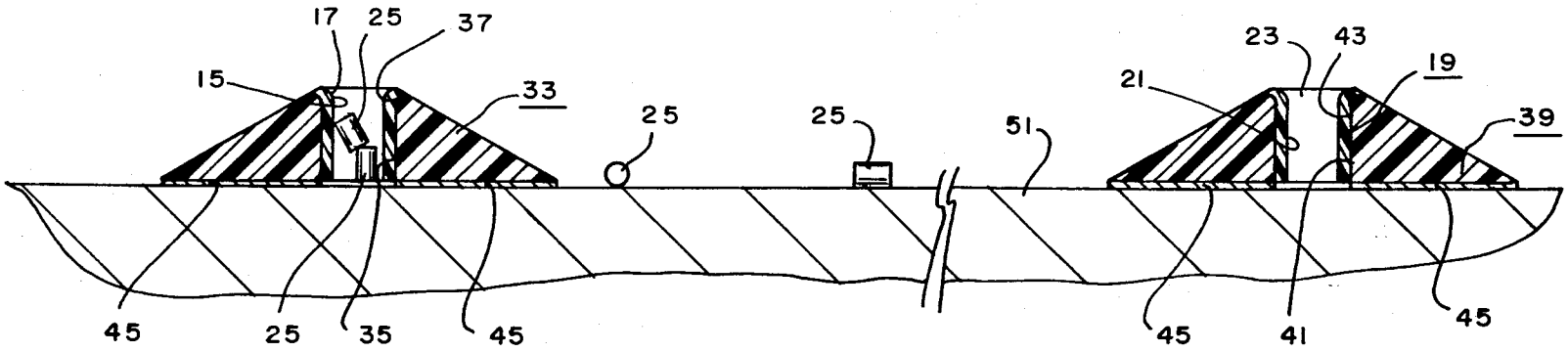

More specifically, the tossing game of the present invention preferably includes a first target means 13 having a cavity 15 with an upwardly opened mouth 17, and a second target means 19 having a cavity 21 with an upwardly opened mouth 23 (see FIGS. 5 and 6). The mouths 17, 23 are preferably flared outwardly with respect to the remainder of the respective cavities 15, 21 to thereby provide each target means 13, 19 with a curved edge on the top thereof. Each target means 13, 19 is preferably formed substantially in the shape of a tube with the cavities 15, 21 thereof extending completely therethrough whereby each cavity 15, 21 has both an opened top and an opened bottom. The target means 13, 19 are preferably constructed out of plastic or the like in any manner now apparent to those skilled in the art such as by being molded or the like. The specific size and shape of each target means 13, 19 may vary depending on the skill level of the players of the tossing game of the present invention, etc.

The tossing game of the present invention preferably includes four cylindrical projectile components 25 (see FIGS. 5 and 6). Each projectile component 25 is identical to one another. Thus, each projectile component 25 preferably has a substantially cylindrical shape to thereby give each projectile component 25 the appearance of a typical soft drink can or the like. Each projectile component 25 is preferably constructed out of plastic or the like in any manner now apparent to those skilled in the art such as by being molded or the like. Each projectile component 25 has a first end 27 and a second end 29. Preferably, the first end 27 of each projectile component 25 is heavier than the second end 29 thereof. The projectile components 25 may be constructed in various specific manners so as to make the first end 27 thereof heavier than the second end 29 thereof. Thus, for example, a weight 31 may be molded in the first end 27 of each projectile component 25. On the other hand, each projectile member 25 may be constructed in a hollow manner with more material located at the first end 27 thereof to thereby make the first end 27 heavier than the second end 29 thereof. Other specific constructions will now be apparent to those skilled in the art. The specific size and shape of each projectile component 25 may vary depending on the size of the cavities 15, 21 of the associated target means 13, 19, the skill level of the players of the tossing game, etc.

The tossing game of the present invention may include at least one base means having a cavity with an upwardly opened mouth for receiving a target means with the target means being substantially submerged below the upper surface of the base means. More specifically, the tossing game of the present invention preferably includes a first base means 33 having a cavity 35 with an upwardly opened mouth 37 for receiving the first target means 13 with the target means 13 being substantially submerged below the upper surface of the base means 33, and a second base means 39 having a cavity 41 with an upwardly opened mouth 43 for receiving the second target means 19 with the target means 19 being substantially submerged below the upper surface of the base means 39 (see FIG. 6). The opened mouth 37, 43 of each base means 33, 39 is preferably flared outwardly with respect to the remainder of each cavity 35, 41 for receiving the flared outwardly upper end of a respective target means 13, 19. Each base means 33, 39 is preferably formed in the shape of a truncated right circular cone and may be constructed substantially out of plastic or the like in any manner now apparent to those skilled in the art, such as by being molded or the like. Each base means 33, 39 preferably has a nonslip bottom surface 45 for preventing inadvertent movement of the base means 33, 39. The nonslip bottom surface 45 may be constructed in various manners now apparent to those skilled in the art. Thus, for example, a nonslip tape or the like may be merely applied to the bottom of each base means 33, 39 or the bottom of each base means 33, 39 may be merely molded with a typical nonslip texture or the like. The specific shape and size of each base means 33, 39 may vary as will now be apparent to those skilled in the art so as to accommodate the specific target means 13, 19.

The tossing game of the present invention may be played on the beach 47 or the like (see FIG. 5) by merely placing the target means 13, 19 in spaced-apart holes 49 dug in the sand or ground. A pair of players can then stand adjacent each target means 13 and toss one or more projectile components 25 at the opened mouth of the opposite target means 13, 19. The player coming closest to the opened mouth of the target means 13, 19 may then be declared the winner.

On the other hand, the tossing game of the present invention may be played indoors on a floor 51 or other rigid support surface (see FIG. 6) by merely placing the base means 33, 39 on the floor 51 spaced apart from one another and inserting a respective target means 13, 19 in the cavity 35, 41 of the respective base means 33, 39. A pair of players can then stand adjacent each target means 13, 19 and toss one or more projectile components toward the opened mouth of the opposite target means 13, 19.

It should be noted that the tossing game of the present invention can be played with any number of players, any number of target means and any number of projectile components. The skill requirements of the tossing game of the present invention may be increased by merely moving the players farther from the target means, reducing the size of the opened mouth of the target means with respect to the size of the projectile component, following various specific rules and procedures, etc.

Although the present invention has been described and illustrated with respect to a preferred embodiment thereof and a preferred use therefore, it is not to be so limited since changes and modifications can be made therein which are within the full intended scope of the invention.

I claim:

1. A tossing game comprising:

(a) at least one target means having a cavity with an upwardly opened mouth for being substantially submerged, said opened mouth of said at least one target means being flared outwardly with respect to the remainder of said cavity;

(b) a plurality of cylindrical projectile components for being tossed at said opened mouth of said at least one target means; each of said projectible components having a first end and a second end, said first end of each of said projectile components being heavier than said second end thereof; and (c) at least one base means having a cavity with an upwardly opened mouth for receiving said at least one target means with said target means being substantially submerged below the upper surface of said at least one base means; said at least one base means having a non-slip bottom surface, said at least one base means being in the shape of a truncated cone.

2. The game of claim 1 in which said at least one target means, each of said projectile components and said at least one base means are constructed substantially out of plastic.

3. A tossing game comprising:

(a) first and second base means for placement on a substantially horizontal support surface spaced apart from one another, each of said base means having a cavity with an upwardly opened mouth and being in the shape of a truncated right circular cone;

(b) first and second target means for fitting substantially submerged into said cavities of said first and second base means respectively, each of said target means having a cavity with an upwardly opened, flared outwardly mouth; and (c) a plurality of cylindrical projectile components for being tossed at said opened mouth of said first or second target means, each of said projectile components having a first end and a second end, said first end of each of said projectile components being heavier than said second end thereof.

4. The game of claim 3 in which said base means, said target means and said projectile components are constructed substantially out of plastic.

* * * * *